United States Patent [19]

Horsewell et al.

[11] Patent Number: 4,700,724

[45] Date of Patent: Oct. 20, 1987

[54] SMOKING-ARTICLES MOUTHPIECES-ELEMENTS

[75] Inventors: Henry G. Horsewell, Totton; Martin G. Duke, Southampton, both of England

[73] Assignee: British-American Tobacco Company Limited, London, England

[21] Appl. No.: 671,221

[22] Filed: Nov. 14, 1984

[30] Foreign Application Priority Data

Nov. 18, 1983 [GB] United Kingdom ..... 8330894

[51] Int. Cl.[4] ..... A24D 3/04

[52] U.S. Cl. ..... 131/336; 131/338; 131/339; 131/340; 131/344

[58] Field of Search ..... 131/338, 336, 339, 340, 131/341, 344

[56] References Cited

U.S. PATENT DOCUMENTS

| | | | |
|---|---|---|---|
| 2,822,813 | 2/1958 | Downs | 131/336 |
| 2,958,328 | 11/1960 | Bartolomeo | 131/336 |
| 3,389,705 | 6/1968 | Levavi | 131/340 |
| 3,678,941 | 7/1972 | Dixon . | |
| 3,860,011 | 1/1975 | Norman | 131/336 |
| 4,362,171 | 12/1982 | Johnson et al. . | |
| 4,515,170 | 5/1985 | Cantrell et al. . | |

*Primary Examiner*—V. Millin

*Attorney, Agent, or Firm*—Kane, Dalsimer, Sullivan, Kurucz, Levy, Eisele & Richard

[57] ABSTRACT

A smoking article mouthpiece element comprises a first portion within which a smoke-passage and a ventilation-duct extends from end-to-end of the portion, a downstream end of the duct being spaced from the periphery of the first portion and the wall and the walls of the duct being gas impervious and a second portion disposed at the end of the first portion being in smoke-flow communication with the smoke passage of the first portion, and gas-impervious wall at the end of said second portion closer to the first portion extending inwardly from a first location at the periphery of the element to a second location at the side of the upstream end of the duct further from the first location, the wall bounding a cavity in communication with the duct and segregated from the interior of the second portion. The first and second portions may form respective parts of an integral unit or may be discrete components disposed in end-to-end abutment. The aforesaid wall is suitably part of the second portion.

Smoke filtration material may be disposed in the smoke passage and/or in the interior of the second portion. The ventilation-duct, which advantageously extends substantially parallel to the longitudinal axis of the first portion, may be one of a plurality of similar duct or ducts.

A smoking article according to the invention may thus comprise a smoking-material rod, a mouthpiece element with a cavity as aforesaid and a wrapper extending about said mouthpiece element and providing for ingress of air to said cavity. The ratio of the velocity of air issuing from the mouth end of said ventilation-duct means to the velocity of smoke issuing from the mouth end of said smoke-passage means being in excess of at least ten, and possibly in excess of twenty when said smoking article is smoked under standard machine-smoking conditions.

In detail, a smoking article mouthpiece element may be substantially as hereinbefore described with reference to FIGS. 1, 2 and 3 or FIGS. 4 and 5 or FIGS. 6 and 7 of the drawing.

9 Claims, 7 Drawing Figures

SMOKING-ARTICLES MOUTHPIECES-ELEMENTS

This invention relates to mouthpiece elements for smoking articles, particularly but not exclusively cigarettes. So-called ventilated-cigarette filters are known which comprise a body of filtration material wrapped in impervious wrapping means in which are formed a plurality of grooves extending to the mouth end of the filter. A tipping overwrap is provided with ventilation perforations some of which overlie the grooves. When a cigarette incorporating such a filter is smoked, tobacco smoke is drawn through the filtration material and ventilation air is drawn through the perforations and into the grooves. Not until the air issues from the mouth end of the grooves does it come into contact with the tobacco smoke. Such filters may be termed "segregated peripheral ventilation (SPV) filters". the air issues from each of the grooves of an SPV filter as a jet. These jets may cause changes in the pattern of the said smoke issuing from the body of filtration material and it has been discovered that changes in this pattern may affect the smoker's sensory perception of the smoke.

SPV filters are described in United Kingdom Patent Application Publication No. 2 046 573A.

Two factors are of importance in causing changes in the smoke pattern and, by selection or application of these two factors in combination, patterns may be obtained which are superior to and/or different from those which have been obtainable from SPV filters. The first factor relates to the ratio of air velocity to smoke velocity. We have found that this ratio should be in excess of ten (10), and preferably in excess of twenty (20), when the smoking takes place under standard machine-smoking conditions. The second factor relates to the degree of contact between the air and the smoke, the greater the degree of contact, the greater effect will the air have on the smoke pattern.

In United Kingdom Patent Application Publication No. 2 100 573A, there is described a cigarette mouthpiece device in the use of which segregated ventilation air issues from the centre of the mouth end of the mouthpiece and tobacco smoke issues from the remaining proportion of the mouth end. Since the air jet is surrounded by smoke, the degree of contact between air and smoke is better than is the case with an SPV filter and thus it could be expected that the smoke pattern would be affected to a greater extent. However, the mouthpiece is of complex construction and may be difficult and expensive to make.

It is an object of the present invention to provide an improved device which is simple and inexpensive to manufacture, whilst maintaining full effectiveness in the control of smoke patterns.

As used herein, the term "mouthpiece element" refers to an element incorporated or to be incorporated in a smoking article at the mouth end thereof. Such an element, or a portion thereof, may take the form of a filter.

The present invention provides a smoking article mouthpiece element comprising a first portion within which smoke-passage means and ventilation-duct means which extends from end-to-end of said portion, a downstream end of said duct means being spaced from the periphery of said first portion and the walls of said duct means being gas impervious, and a second portion disposed at the end of the first portion distant from said downstream end of said duct means, the interior of said second portion being in smoke-flow communication with said smoke passage means of said first portion, and gas-impervious wall means at the end of said second portion closer to said first portion extending inwardly from a first location at the periphery of said element to a second location at the side of the upstream end of said duct means further from said first location, said wall means bounding a cavity in communication with said duct means and segregated from the interior of said second portion.

Mouthpiece elements according to the present invention may comprise more than one such ventilation-duct means, in which case the upstream ends thereof may communicate with a single such cavity or each duct means may communicate with a respective one of a plurality of such cavities.

The or each ventilation duct means may take a variety of paths between the upstream and downstream ends thereof. If one only ventilation duct means is provided, it may advantageously extend co-axially of the mouthpiece element.

The first and second portions may be formed as an integral unit. Alternatively, the first and second portions may be provided as discrete components which are placed in end-to-end abutment. In the latter case, the or each wall means is advantageously provided by the second portion.

Smoke filtration material in, for example, fibrous form, may be disposed in the smoke passage of the first portion and/or in the interior of the second portion.

In order that the invention may be clearly understood and readily carried into effect, reference will now be made, by way of example, to the accompanying drawings, in which.

Figure 1:
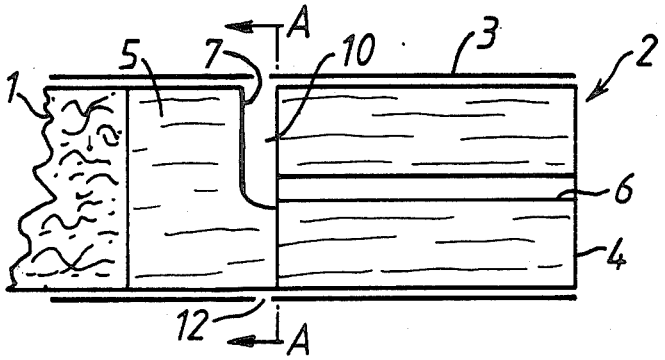
FIG. 1 shows, in diagrammatic axial section, parts of a cigarette comprising a mouthpiece element.
Figure 2:
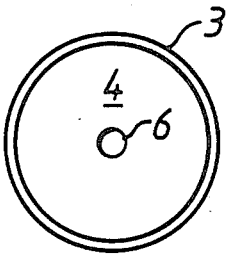
FIG. 2 is an end view of the mouthpiece element of FIG. 1.
Figure 3:
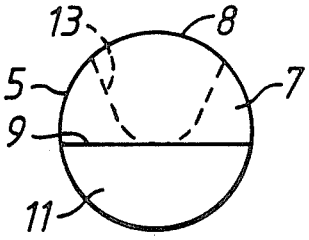
Figure 4:
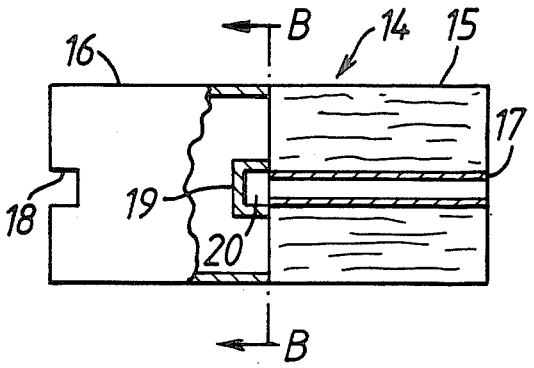
Figure 5:
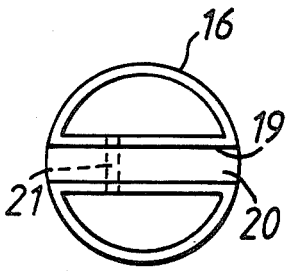
Figure 6:
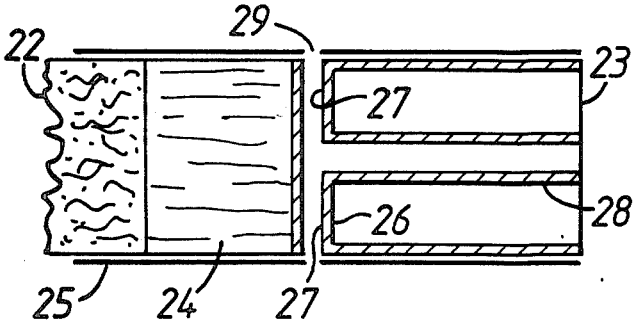
Figure 7:
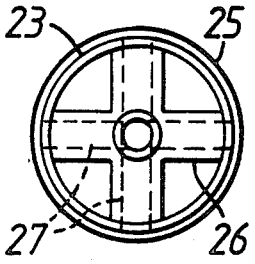

FIG. 3 an end view, taken on line A—A of FIG. 1, of a portion of the mouthpiece element of FIG. 1;

FIG. 4 shows, partly in axial section, a mouthpiece element of a form different from that of the element in FIG. 1;

FIG. 5 is an end view, taken on line B—B of FIG. 4, of a portion of the element shown in FIG. 4;

FIG. 6 shows, in diagrammatic axial section, parts of a cigarette comprising yet a further form of mouthpiece element, and FIG. 7 is an end view of the mouthpiece element shown in FIG. 6.

The cigarette of which parts are shown in FIG. 1 comprises a tobacco rod 1 and a mouthpiece element 2, which rod and element are interattached by a tipping wrapper 3. The mouthpiece element 2 is formed of two abutting, self-sustaining, cylindrical plugs 4 and 5 of cellulose-acetate fibres.

Extending co-axially within the downstream plug 4, from end-to-end of the plug, is a bore 6 providing a ventilation duct. The bore 6 may be thermally formed, preferably in such manner as to effect a fusion of the cellulose-acetate fibres to produce an impervious bore wall. If the thermal formation process itself does not result in an impervious wall, the wall may be rendered impervious by the application thereto of a sealant material. Alternatively, the bore 6 may be provided by a length of tubing of gas-impervious plastics or other material. The body of cellulose acetate fibres surrounding the bore 6 provides a filtration smoke passage through the plug 4.

The plug 5 comprises, at the end thereof nearer the plug 4, a notch 7 which, as can be seen from FIG. 3, extends fully across the plug 5. The notch 7 may extend from an uppermost location 8 at the periphery of the plug 5 to a chordal line 9 to the side of the bore 6 further from the peripheral location 8. The wall defining the notch 7 is gas-impervious. The imperviousness may be imparted as a result of a thermal process of formation of the notch 7. Alternatively, the wall of the notch 7 may be rendered gas-impervious by the application thereto of a hot-melt or other sealant material. A polyethylene hot-melt adhesive may, for example, be used. Similarly, the peripheral wall of the plug 5 should be impervious or rendered impervious.

The notch 7 and the facing-upstream end wall of the plug 4 define a cavity 10 which communicates with the ventilation duct 6 extending through plug 4. That portion 11 of the downstream end of the plug 5 which is not occupied by the notch 7 is in smoke-flow communication with the smoke passage constituted by the body of cellulose-acetate fibres of the plug 4.

The tipping wrapper 3, which is otherwise air impermeable, is provided with a line or zone of ventilation perforations 12 which encircles the mouthpiece element 2 at the location of the notch 7. Thus a significant proportion of the perforations 12 of the line thereof overlies the notch 7. If a further wrapper, underlying the tipping wrapper 3, is used to interattach the plugs 4 and 5, it should be provided with perforations in register with perforations 12 of the wrapper 3, or it should be of highly porous material.

When the cigarette of FIG. 1 is smoked, air is drawn through the perforations 12 into the cavity 10 and therefrom through the bore 6. At the same time, tobacco smoke is drawn through the body of cellulose-acetate fibres of the plug 5 and then through that of the plug 4. The smoke issues from the downstream end of the plug 4 as an annular stream surrounding the axial jet of air issuing from the bore 6. The cross-sectional area of the bore 6 is so selected as to ensure that the velocity of the air is well in excess, by a factor of at least more than ten, of the velocity of the smoke. Because the jet of air issuing from the bore 6 is completely surrounded by smoke and because the air/smoke velocity ratio is high, a marked effect on the smoke pattern is obtained.

If, for example, the cross-sectional area of the bore 6 is 2 $mm^2$, the annular cross-sectional area of the smoke passage in plug 4 is 48 $mm^2$ and the relative pressure drops of the ventilation-air and tobacco-smoke paths through the mouthpiece element 2 are such that the ventilation level is 50%, then the air/smoke velocity ratio will be about twenty-four, when measured under standard machine-smoking conditions.

The notch 7 in the plug 5 may have a boundary within the plug of a form other than a straight chordal line. Thus, for example, the boundary may be of substantially a V-form, as indicated by broken line 13 in FIG. 3, whereby the cross-sectional area available for smoke flow from the plug 5 to the plug 4 is enlarged. As may be seen from FIG. 1, that portion of the wall of the notch 7 which extends from the location 8 extends perpendicularly to the axis of the mouthpiece; but it could be inclined so that the notch 7 increased in depth in a direction towards location 8.

As with the mouthpiece element 2, mouthpiece element 14 as shown in FIGS. 4 and 5 comprises two abutting components, these being a self-sustaining, cylindrical plug 15 of cellulose-acetate fibres and a tubular unit 16 of plastics material. In FIG. 4, the plug 15 is shown in axial section and the unit 16 partly in axial section and partly non-sectioned. The plug 15 and the unit 16 may be interattached by means of a porous plugwrap (not shown).

The plug 15 has extending axially therethrough a length of tubing 17 providing a ventilation duct. The tubing 17 is of a gas-impervious plastics material. The unit 16 takes the form of a thin-walled, gas-impervious, plastics tube having extending diametrically across it at opposite ends integral channel portions 18, 19. Each of said channel portions bounds a cavity which, in the case of the cavity 20 at the down-stream end of the unit 16, is sealingly closed by contact of the outer edges of the channel portion 19 with the upstream end of the plug 15. As may be seen from FIG. 4, the cavity bounded by channel portion 19 is in communication with the bore of the tubing 17.

When the mouthpiece element 14 is incorporated in a cigarette, it is attached to the tobacco rod thereof by means of a tipping overwrap (not shown) comprising ventilation perforations at least one of which communicates with each of the open ends of the channel portion 19. In other words, when the cigarette is smoked, air may be drawn into the cavity 20 through the perforations. From the cavity 20, air flows along tubing 17, from which it issues as a high velocity jet. Tobacco smoke may flow from the interior unit 16, to each side of the channel portion 19, into the annular smoke passage of plug 15, from which it flows as a stream surrounding the air issuing from the tubing 17.

Although that portion of the upstream end face of plug 15 which bounds cavity 20 is not gas-impervious, little of the air entering cavity 20 flows into the body of cellulose-acetate fibres of plug 15, since a lower flow impedance path is available through the tubing 17.

Instead of extending fully across the unit 16, the channel portions 18, 19 could extend from the periphery of the unit for a distance short of the diametrically opposed portion of the periphery. Thus the broken lines in FIG. 5 indicate an end closure wall 21 of the channel portion 19. Such a shortened channel portion must extend for a sufficient distance for the cavity bounded thereby to be in communication with the bore of the tubing 17.

The channel portions 18, 19 could be formed with an increasing width in a radially outward direction to permit an increased number of perforations in the tipping wrapper to be in communication with the cavity 20 at the downstream end of the unit 16.

The cigarette of which parts are shown in FIG. 6 comprises a cigarette rod 22, a mouthpiece element 23 and a plug 24 of self-sustaining cellulose-acetate fibres disposed intermediate and in abutment with the rod 22 and the element 23. The element 23 and the plug 24 are interattached by a porous plugwrap (not shown) and these are in turn attached to the rod 22 by a tipping wrapper 25.

The mouthpiece element 23 is generally of the form of a thin walled tube of gas-impervious plastics material comprising at the upstream end thereof an integral cruciform spider 26. Within each arm of the spider 26 there extends a duct-form cavity 27. Each of the cavities 27 is open at the periphery of the element 23 and is in communication at its inner end with the bore of a small bore tube 28 which extends from the spider 26 co-axially of the element 23 to the downstream end of that element. As is indicated in FIG. 6, the upstream end of the tube 28 is integral with the spider 26.

The tipping wrapper 25, which is othrwise air impermeable, is provided with a line of perforations 29, of which one at least communicates with each of the cavities 27.

In the smoking of the cigarette of FIG. 6, tobacco smoke passes through the plug 24 and thence into the element 23 through the quadrant-section aperatures defined by the arms of the spider 26 and the peripheral wall of the element 23. Ventilation air is drawn through the perforations 29 into the cavities 27 and thence through the tube 28, the air jet issuing from the tube 28 being surrounded by the stream of tobacco smoke.

If desired, smoke filtration material may be disposed in the smoke passage of the element 23.

We claim:

1. A smoking article mouthpiece element for the downstream end of a tobacco column which comprises: a first element portion and a second element portion together being defined by an outer peripheral wall, said first portion being defined by a downstream end and an upstream end, a peripheral wall extending between said ends, a longitudinal duct with a gas impervious duct wall extending between said ends, said duct opening at said upstream and downstream ends at respective locations spaced from said peripheral wall of said element, and a smoke passage separate from said longitudinal duct extending between said ends, said second portion disposed at the upstream end of said first portion, the interior of said second portion being open at the upstream end of said second portion and communicating directly at its downstream end with said smoke passage of said first portion, at least one of said portions containing filtr material, and a transversal air passage disposed at or near to the junction of said first and second portions, said air passage being open through the peripheral wall of the element to ambient air and extending inwardly from the wall opening to the longitudinal duct at the upstream end of said first portion for connecting said longitudinal duct to the ambient air whereby only ambient air flows through said longitudinal duct.

2. A mouthpiece element according to claim 1, in which said first and second portions form respective parts of an integral unit.

3. A mouthpiece element according to claim 1, in which said first and second portions are discrete components disposed in end-to-end abutment.

4. A mouthpiece element according to claim 3, wherein said transversal air passage comprises a wall means attached to said second portion.

5. A mouthpiece element according to claim 1, in which said ventilation-duct means extend substantially parallel to the longitudinal axis of said first portion.

6. A smoking article comprising a smoking material rod, a mouthpiece element according to claim 1 and a wrapper extending about said mouthpiece element and providing for ingress of air to said transversal air passage, the ratio of the velocity of air issuing from the mouth end of said duct to the velocity of smoke issuing from the mouth end of said smoke-passage means being in excess of at least ten when said smoking article is smoked under standard machine-smoking conditions.

7. A smoking article according to claim 6, in which said ratio is at least twenty.

8. A mouthpiece element according to one of claims 1, 2, 3 or 4, in which said longitudinal duct extends substantially parallel to the longitudinal axis of said first portion.

9. A mouthpiece element according to one of claims 1, 2, 3 or 4, wherein smoke filtration material is disposed in at least one of said first and second portions.

* * * * *